United States Patent [19]

Kazumoto et al.

[11] Patent Number: 4,872,313

[45] Date of Patent: Oct. 10, 1989

[54] GAS CYCLE MACHINE

[75] Inventors: Yoshio Kazumoto; Takuya Suganami; Yoshiro Furuishi; Kazuo Kashiwamura, all of Hyogo, Japan

[73] Assignee: Mitsubishi Denki Kabushiki Kaisha, Tokyo, Japan

[21] Appl. No.: 239,822

[22] Filed: Sep. 2, 1988

[30] Foreign Application Priority Data

Sep. 4, 1987 [JP] Japan ..... 221342/1987

[51] Int. Cl.[4] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 3,774,405 | 11/1973 | Leo | 62/6 |
| 3,991,585 | 11/1976 | Mulder | 62/6 |
| 3,991,586 | 11/1976 | Acord | 62/6 |
| 4,044,558 | 8/1977 | Benson | 60/520 |
| 4,188,791 | 2/1980 | Mulder | 60/520 |
| 4,199,945 | 4/1980 | Finkelstein | 60/520 |
| 4,372,127 | 2/1983 | Pohlmann et al. | 62/6 |
| 4,498,296 | 2/1985 | Dijkstra et al. | 62/6 |

*Primary Examiner*—Ronald C. Capossela

*Attorney, Agent, or Firm*—Sughrue, Mion, Zinn, Macpeak and Seas

[57] ABSTRACT

A gas cycle machine includes a moving coil composed of a first moving coil portion and a second moving coil portion opposing to the first moving coil portion and a magnetic circuit is constituted such that magnetic flux in a first gap in which the first moving coil portion is disposed passes through the first moving coil portion inwardly and magnetic flux in a second gap in which the second moving coil portion is disposed passes through the latter outwardly. Magnetic flux of a permanent magnet passes through the first and the second gaps in opposite directions, respectively, and, therefore, a closed magnetic circuit is composed of the permanent magnet, a cylinder of soft iron and an annular disc, which eliminates the necessity of providing a large circular disc as in the conventional engine.

4 Claims, 5 Drawing Sheets

GAS CYCLE MACHINE

BACKGROUND OF THE INVENTION

The present invention relates to a gas cycle machine and, particularly, to a generation of cryogenic temperature.

FIG. 5 shows, in partial cross section, a conventional gas cycle machine such as disclosed in Japanese Patent Publication No. 28980/1979. In FIG. 5, a reference numeral 1 depicts a cylinder in which a piston 2 and a free-displacer 3 reciprocate with a phase difference therebetween. A compression space 4 provided between a working surface of the piston 2 and a working surface 3*a* of the free-displacer 3 holds a cooler 5. An upper working surface 3*b* of the free-displacer 3 defines a border line of an expansion space 6 which, together with the compression space 4, forms a working space. A regenerator 7 disposed in the free-displacer 3 can communicate through a lower central hole 8 with a working gas existing below and through an upper center hole 9 and a radial duct 10 with a working gas above. A freezer 11 is also included for heat exchange between a cold working gas expanded and a member to be cooled. seals 12 and 13 are provided between the piston 2 and the cylinder 1 and seals 14 and 15 are provided between the free-displacer 3 and the cylinder 1. A sleeve 16 of non-magnetic, light-weight material such as hard paper or aluminum is provided around a lower portion of the piston 2. The sleeve 16 has a movable coil 17 thereon from which lead wires 18 and 19 extend through a wall of a housing 20 connected air-tightly to the cylinder 1, externally. Ends of the lead wires 18 and 19 are connected to electric contacts 21 and 22 disposed externally of the housing 20, respectively. The movable coil 17 can reciprocate axially within an annular gap 23 in which a armature magnetic field is established. Magnetic flux of the magnetic field extends in the gap so that it traverses the moving passage of the movable coil 17. The magnetic field is obtained, in the shown example, by an annular permanent magnet 24 magnetic poles at an upper and a lower end , an annular disc 25 of soft iron, a solid cylinder 26 of soft iron and a circular disc 27 of soft iron. The permanent magnet 24 and the yoke members 25, 26 and 27 form a closed magnet circuit. The piston 2 is provided with a support spring 28 for keeping the center of the piston 2 stably. An upper end of the support spring is locked on a protrusion 29 and a lower end thereof is locked around terminal member 30 to prevent lateral movement thereof. The free-displacer 3 is supported at a lower end thereof by a resilient member 31 by which a stroke of the free-displacer 3 is limited.

In operation, when an alternating current is supplied through the lead wires 18 and 19 connected to the electric contacts 21 and 22 to the moving coil 17, a Lorentz force exerted vertically on the moving coil 17 due to an interaction of the permanent magnetic field in the annular gap 23 and the current flowing therethrough. As a result, an assembly composed of the piston 2, the sleeve 16 and the moving coil 17 starts to vibrate. The vibration of the piston 2 varies the volume of the compression space 4 upon which the working gas filling the working space is compressed and expanded to change gas pressure. This change of gas pressure causes a periodical change of pressure difference across the regenerator 7, resulting in that the free-displacer 3 moves at the same frequency as that of the piston 2 with different phase to each other due to a time lag between a motion of the free-displacer 3 and the pressure difference variation.

With the movements of the piston 2 and the freedisplacer 3 in different phases, the working gas such as helium gas in the working space experiences a thermodynamic cycle well known as the Inversed Stirling Cycle resulting in a cold state in the expansion space 6.

Since, in the conventional gas cycle machine, the permanent magnet 24 and the parts 25, 26 and 27 all of which are formed of soft iron constitute a closed magnetic circuit, the size of the circular disc 27 must be large causing the overall size of the machine to be large.

SUMMARY OF THE INVENTION

An object of the present invention is to provide a gas cycle machine which is compact and light-weight.

A gas cycle machine according to the present invention includes a moving coil composed of a first moving coil portion and a second moving coil portion opposing to the first moving coil portion and a magnetic circuit is constituted such that magnetic flux in a first gap in which the first moving coil portion is disposed passes through the first moving coil portion inwardly and magnetic flux in a second gap in which the second moving coil portion is disposed passes through the latter outwardly.

In the gas cycle machine according to the present invention, magnetic flux of a permanent magnet passes through the first and the second gaps in opposite directions, respectively, and, therefore, a closed magnetic circuit is composed of the permanent magnet, a cylinder of soft iron and an annular disc, which eliminates the necessity of providing a large circular disc as in the conventional machine.

DETAILED DESCRIPTION OF THE PREFERRED EMBODIMENT

Figure 1:
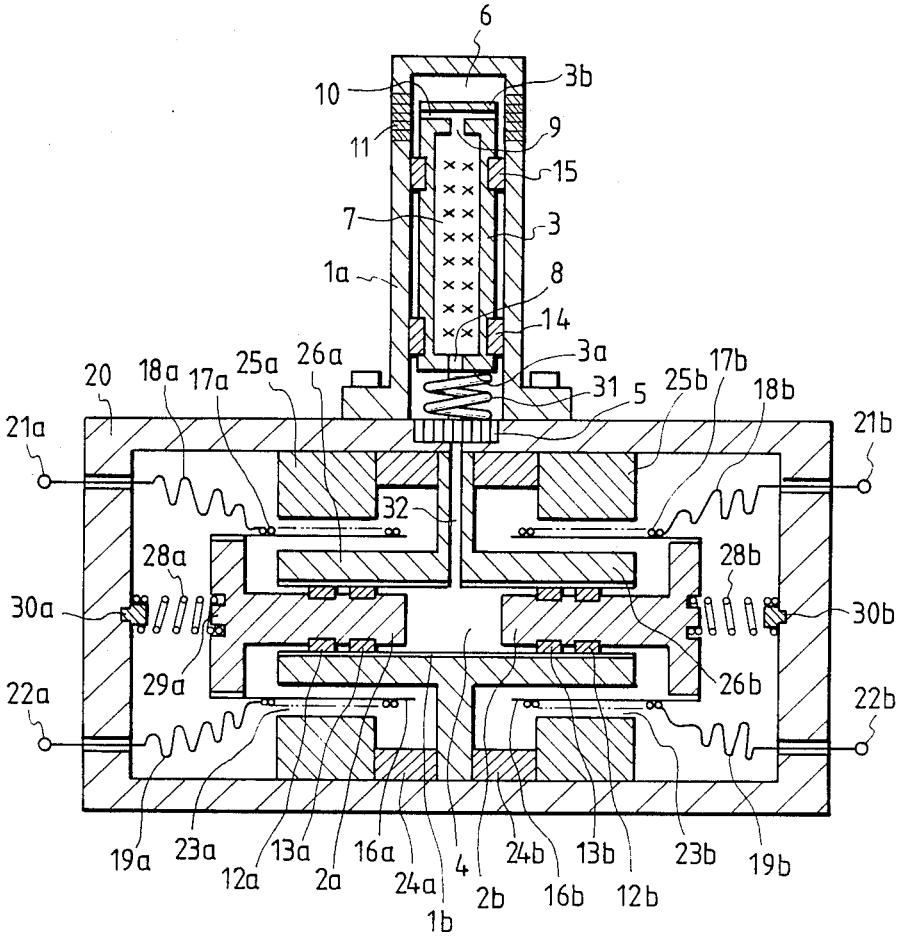
FIG. 1 is a cross section of an embodiment of the present invention.

In FIG. 1 which shows an embodiment of the present invention, a free-displacer 3 is adapted to reciprocate in a cylinder 1*a*. A compression space 4 defined by a working surface of a first piston 2*a*, a working surface of a second piston 2*b* and a working surface 3*a* of the free-displacer 3 includes a passage 32 and a space in which a cooler 5 is disposed. First piston seals 12*a* and 13*a* are disposed between a wall of the cylinder 1b and the first piston 2*a* and second piston seals 12*b* and 13*b* are disposed between the cylinder 1b and the second piston 2*b*. Seals 14 and 15 are provided between the free-displacer 3 and the cylinder wall 1*a*.

The first piston 2*a* and the second piston 2*b* are associated with a first and a second sleeves 16*a* and 16*b* of light-weight, non-magnetic material such as synthetic resin or aluminum and a first moving coil 17*a* and a second moving coil 17b are wound thereon, to which one ends of first lead wires 18a and 19a and second lead wires 18b and 19b are connected, the other ends thereof being connected through a wall of a housing 20 to first electric contacts 21a and 22a and second electric contacts 21b and 22b, respectively.

The moving coils 17a and 17b are coupled to the pistons 2a and 2b and movable along the latter within the first and the second gaps 23a and 23b, respectively. In the gaps 23a and 23b, radial magnet fields exist in directions traversing the moving directions of the moving coils 17a and 17b, respectively, such that magnetic flux thereof extends in the first gap 23a radially outwardly and in the second gap 23b radially inwardly. The magnetic fields in the gaps 23a and 23b are produced by closed magnetic circuits including permanent magnets 24a and 24b, annular discs 25a and 25b and cylinders 26a and 26b of soft iron, respectively.

The pistons 2a and 2b are associated with respective support springs 28a and 28b having opposite ends fitted on protrusions 29a and 29b and 30a and 30b, respectively, as shown to prevent their lateral movements with respect to the axis thereof to thereby hold them in fixed center positions, respectively.

A resilient member 31 is provided beneath the free-displacer 3 to limit its stroke.

Figure 2A:
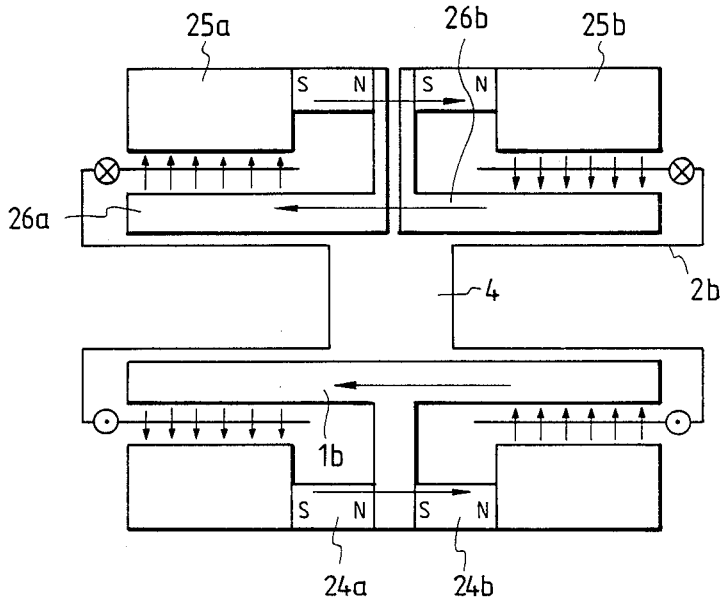
FIGS. 2*a* and 2*b* show a magnetic configuration of the embodiment in FIG. 1 and a displacement of a working surface of a piston thereof, respectively.
Figure 2B:
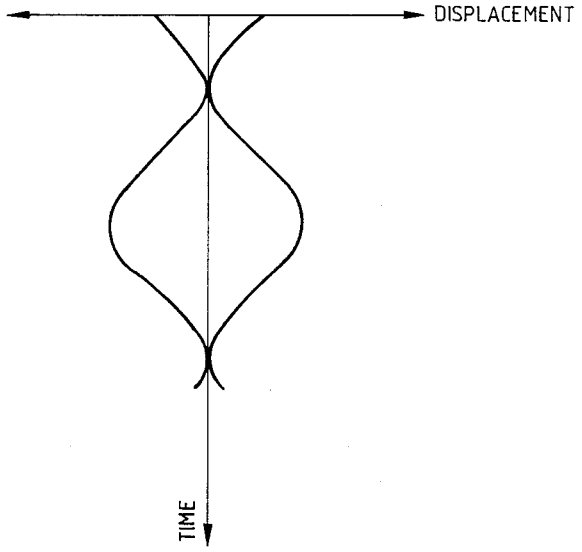

FIG. 2a shows a magnetic circuit of the gas cycle machine shown in FIG. 1, in which a direction of magnetic flux is shown by an arrow, and FIG. 2b is a graph showing a displacement of working surfaces of the pistons, with level of piston and time being shown in abscissa and ordinate, respectively.

In operation, when an alternating current is supplied through the electric contacts 21a, 22a, 21b and 22b and the lead wires 18a, 19a, 18b and 19b to the moving coils 17a and 17b, respectively, axial Lorentz forces are exerted on the assemblies including the sleeves 16a and 16b and the moving coils 17a and 17b due to interaction between the permanent magnetic fields in the respective gaps 23a and 23b and the currents flowing through the coils 17a and 17b disposed in the gaps, so that the assemblies start to vibrate axially.

Assuming that the first and the second moving coils 17a and 17b have identical characteristics, that magnetic field strength in the gaps 23a and 23b are also identical and that alternating currents having same amplitude and same phase are supplied to the moving coils 17a and 17b, magnetic flux is generated as shown by arrows in FIG. 2a. Since, as shown, directions of magnetic flux in the gaps 23a and 23b are opposite, the first and the second moving coils 17a and 17b vibrate in opposite directions with identical amplitude as shown in FIG. 2b. As a result, a volume of the compression space 4 defined by the pistons 2a and 2b varies periodically upon which the working gas therein is compressed and expanded alternatively, causing a variation of gas pressure which produces a periodic pressure difference across the regenerator 7. With such periodic pressure difference, the free-displacer 3 vibrates at the same frequency a that of the pistons 2a and 2b while being in different phase therefrom .

The out of phase movements of the free-displacer 3 and the pistons 2a and 2b causes the working gas such as helium to perform the thermodynamic cycle known as the Inverse Stirling Cycle, resulting in a cold state in the expansion space 6. In this embodiment in which the magnetic flux in the gaps 23a and 23b are opposite, the closed magnetic circuit of the device is constituted with the permanent magnets 24a and 24b, the soft iron cylinders 25a and 25b, the annular discs 26a and 26b.

With such closed magnetic circuit construction, there is no circular disc such as required in the conventional device and thus the weight and size of the device can be reduced correspondingly.

Figure 3:
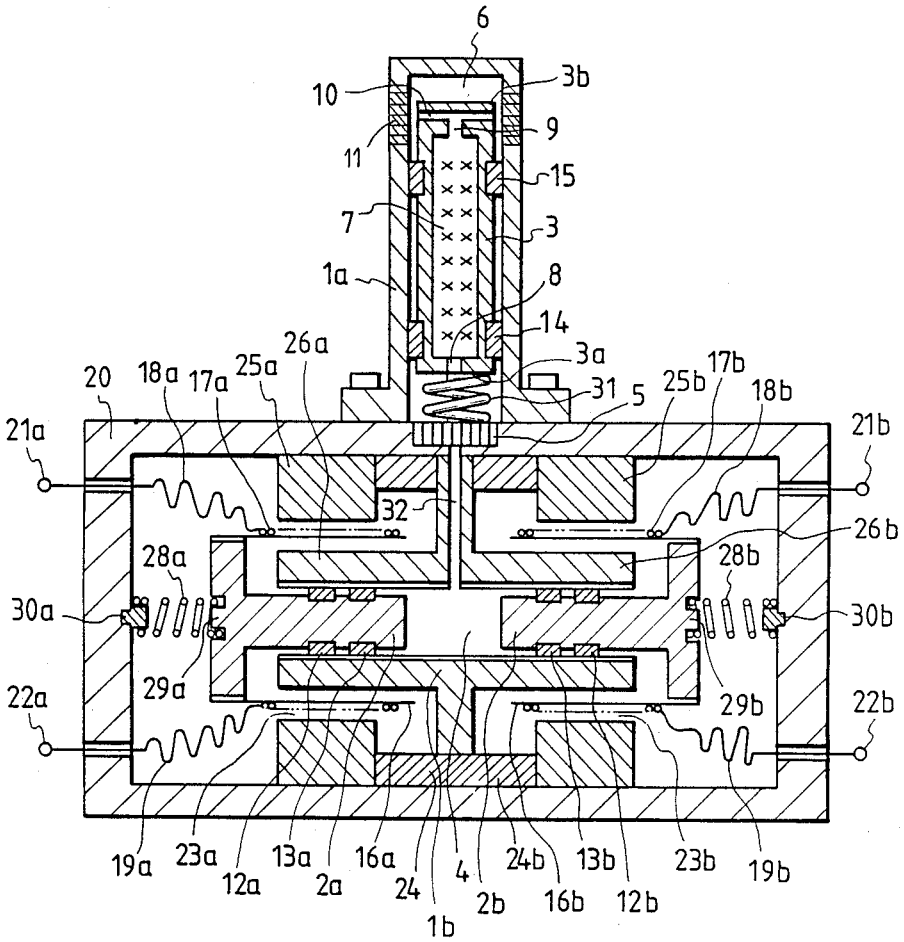
FIG. 3 shows, in cross section, another embodiment of the present invention.

The two magnets 24a and 24b used in this embodiment can be replaced by a single permanent magnet 24 as shown in FIG. 3.

Figure 4:
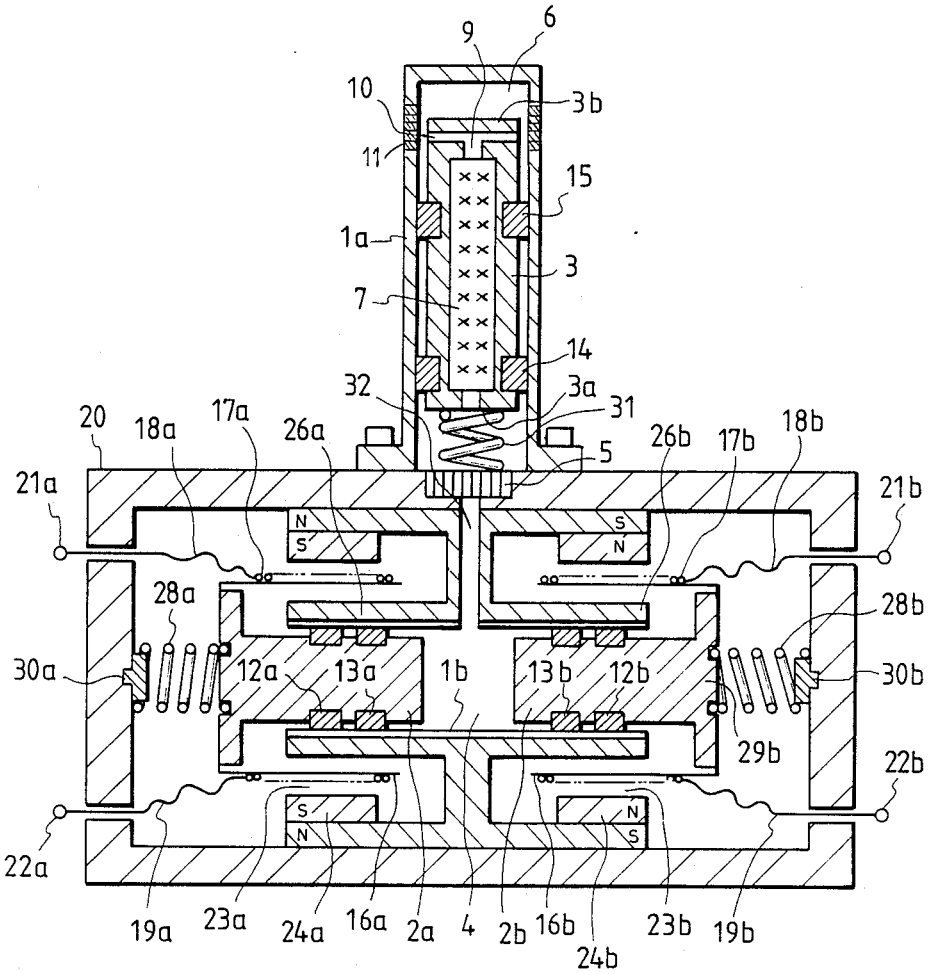
FIG. 4 shows a further embodiment of the present invention.
Figure 5:
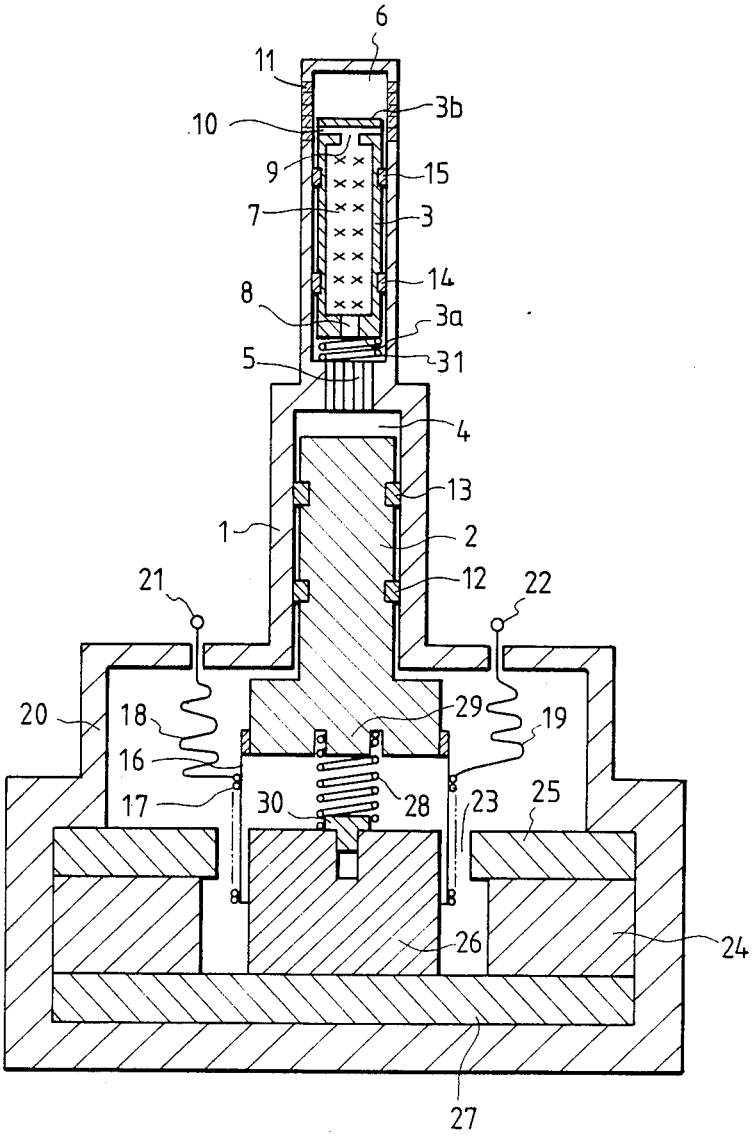
FIG. 5 PRIOR ART
FIG. 5 is a construction of a conventional gas cycle machine.

FIG. 4 shows another embodiment of the present invention which differs from that shown in FIG. 1 in that magnets 24a and 24b are magnetized radially oppositely such that same magnetic flux directions in the gaps 23a and 23b as those shown in FIG. 2a are obtained. Since other portions are substantially the same as those described with respect to the preceding embodiments, details thereof are omitted in this description.

As described hereinbefore, according to the present invention in which two sets of the moving coils are provided such that they vibrate in opposite directions at same amplitude and phase, undesired vibration thereof are cancelled out each other.

Further, due to the opposite magnetic flux in the gaps 23a and 23b, the large circular disc becomes unnecessary, rendering the device compact and light-weight.

What is claimed is:

1. A gas cycle machine, comprising: permanent magnet means (24), a first moving coil (17a) disposed in a first gap (23a) through which magnetic flux from said permanent magnet means passes in a first direction, a second moving coil (17b) disposed in a second gap (23b) through which magnetic flux from said permanent magnet means passes in a second direction opposite to said first direction, a first piston (2a) connected to said first moving coil, a second piston (2b) connected to said second moving coil, a compression space (4) defined between said first and said second pistons, a working gas disposed in said compression space such that when an alternating current is supplied to said first and second moving coils, alternating compression and expansion of said working gas is produced in said compression space, and means defining a working gas ingress and egress passage (32) between said compression space and a utilization device.

2. The gas cycle machine as claimed in claim 1, wherein said first and said second moving coils vibrate oppositely in phase with same amplitude.

3. The gas cycle machine as claimed in claim 1 or 2, wherein said permanent magnet means comprises a pair of permanent magnets and armature means, said permanent magnets and said armature means being arranged in such a way that said magnetic flux in said first and said second gaps are produced by them, respectively.

4. The gas cycle machine as claimed in claim 1 or 2, wherein said permanent magnet means comprises a single permanent magnet and armature means, said permanent magnet and said armature means being arranged in such a way that said magnetic flux in said first and said second gaps are produced by , them.

* * * * *